United States Patent [19]

Henninger

[11] 4,101,858

[45] Jul. 18, 1978

[54] HIGH TORQUE ROTARY ELECTROMAGNETIC ACTUATOR

[76] Inventor: William H. Henninger, 702 Bancroft Pl., Paramus, N.J. 07652

[21] Appl. No.: 752,479

[22] Filed: Dec. 20, 1976

[51] Int. Cl.[2] ..... H01F 7/14

[52] U.S. Cl. ..... 335/272; 355/279

[58] Field of Search ..... 310/36; 335/272, 279, 335/281

[56] References Cited

U.S. PATENT DOCUMENTS

| | | | |
|---|---|---|---|
| 3,229,170 | 1/1966 | Daugherty et al. | 335/272 |
| 3,278,875 | 10/1966 | McDonough | 335/272 |

FOREIGN PATENT DOCUMENTS

| | | | |
|---|---|---|---|
| 215,679 | 5/1924 | United Kingdom | 335/272 |

*Primary Examiner*—George Harris

*Attorney, Agent, or Firm*—Lackenbach, Lilling & Siegel

[57] ABSTRACT

A high torque rotary electromagnetic actuator is described which includes a U-shaped stator formed from a substantially planar sheet of magnetic iron to have two parallel leg portions joined by a transverse connecting portion. The single piece stator which is so formed is joined to an axial core which is staked or riveted to the stator connecting portion by an intimate or press-fit to minimize reluctance to the magnetic flux flowing through the stator and core. The rotor is mounted on the free end of the core and is provided with cam surfaces for providing variable gaps with relative rotation between the rotor and the stator. The rotor is provided with an enlarged axial hub portion which is configured to compensate for the reduced axial thickness thereof produced by the provision of a counterbore which receives a portion of the core therein. The construction of the actuator, as well as the materials the use of which is made possible by such construction, increases the strength of the magnetic field generated in the actuator to result in substantial increases in torque outputs available from such actuator.

17 Claims, 8 Drawing Figures

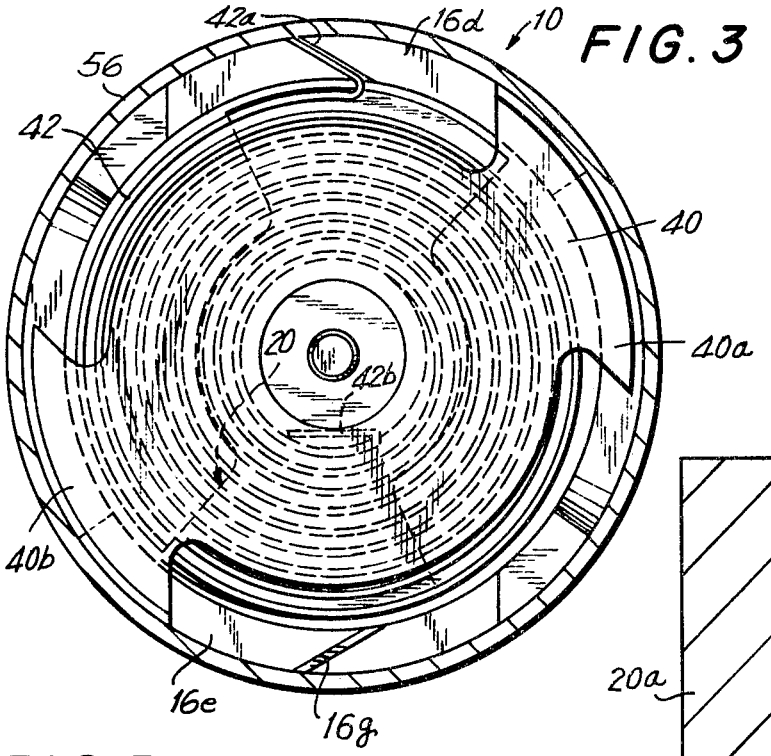
FIG. 3
FIG. 4
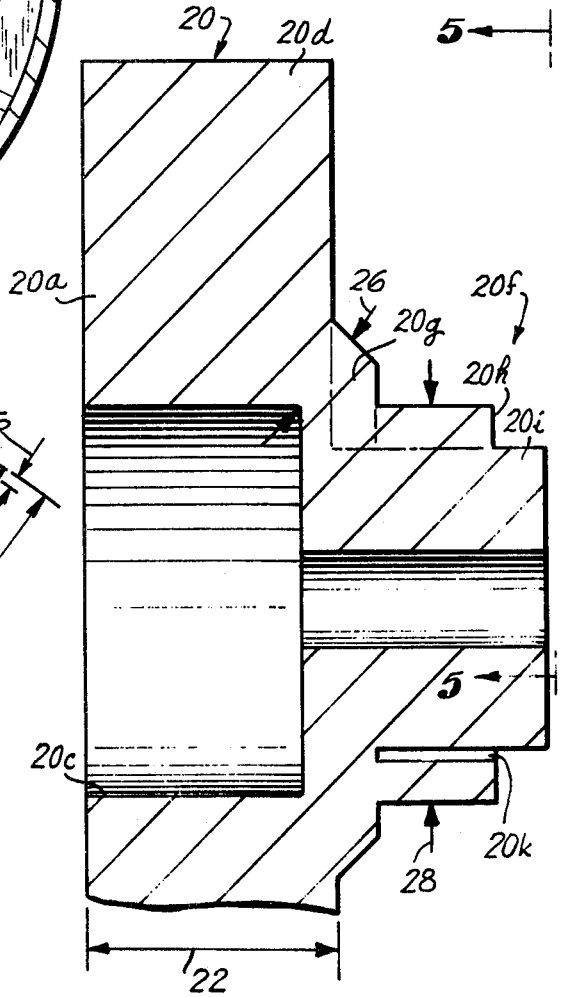
FIG. 5
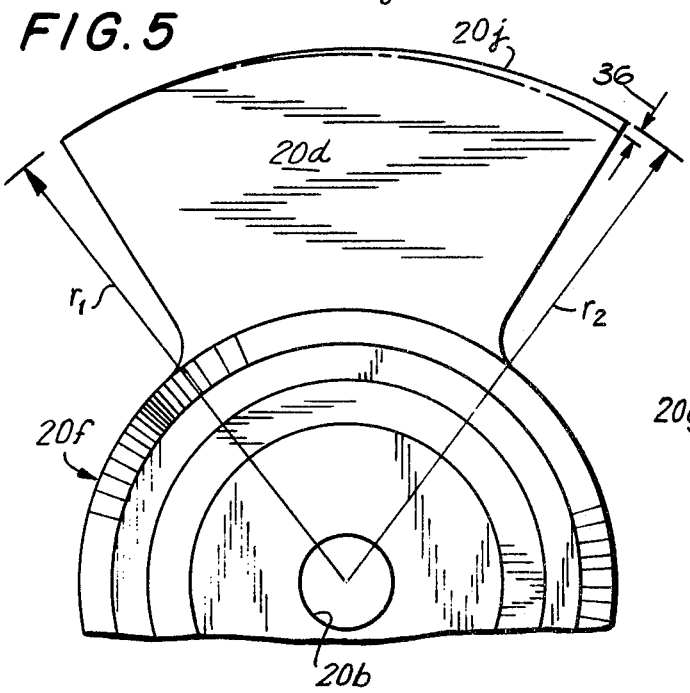
FIG. 6
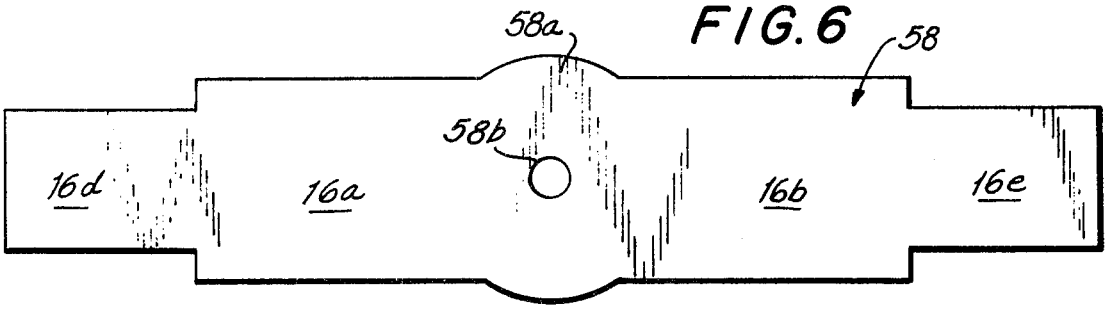

HIGH TORQUE ROTARY ELECTROMAGNETIC ACTUATOR

BACKGROUND OF THE INVENTION

This invention generally relates to angular displacement devices, and more specifically to a high torque rotary electromagnetic actuator of the type generally used on miniature electromagnetic indicators.

Miniature rotary electromagnetic actuator indicators are well known in the art and are utilized to provide various types of indications. Most frequently, such indicators are used to provide changes in conditions or states, and are used very frequently, because of their size and small power consumption, in aircraft and other vehicles.

The miniature rotary electromagnetic rotary indicators of the type under discussion advantageously have the following properties. Firstly, it is important that the actuators develop sufficient torque to permit the rotary movement of an indicator, such as a flag or the like, which is typically attached to the shaft of the actuator. Because of the uses to which the actuators are typically put, it is imperative that the actuators be reliable and provide the desired indications or changes in indications or over wide ranges of applied signals or power supply voltages. It is also desirable that the actuators have well defined end positions, so that a positive indication can be provided to the viewer and there is no ambiguity as to the condition which the actuator monitors.

As a result of the above requirements, which are among the more important ones to be taken into consideration in the design and manufacture of such actuators, the tolerances of manufacture are frequently critical, this resulting in high manufacturing costs. The problems associated with miniature rotary actuators of the type being considered is compounded by the fact that the dimensions of such actuators are very small to begin with, so that the tolerances are even tighter and the use of special tools must be employed to shape or form the various parts which make up the actuator. This further increases the manufacturing costs.

The desirable high torque outputs, over the entire operative range of rotation of the actuators, are a function of the magnitude or strength of the magnetic fields which can be developed. The strength of the magnetic field, on the other hand, is a function, among other things, of the size of the coil or the number of turns which can be employed in the actuator, and the reluctance of the magnetic circuit. The magnetic reluctance, in turn, is a function of the magnetic materials used, as well as the air gaps formed in the magnetic circuit. The size of the coil is essentially fixed once the size of the miniature actuator is selected. Only so many turns can be used in such an actuator, and still provide sufficiently low coil resistance so as to permit the necessary current levels to flow therethrough. However, in the prior art constructions, the actuator reluctances have not been minimized and, therefore, the torques have not been optimized.

An angular displacement solenoid is disclosed in U.S. Pat. No. 3,221,191, issued on Nov. 30, 1965, discloses a rotor and stator construction in which the rotor is rotatably mounted on the central portion of an E-shaped stator. However that patent teaches the use of a channel-shaped hub member affixed to the shaft on which the rotor is mounted and which is made of a non-magnetic material. Being non-magnetic, the hub presents a high reluctance to the axial components of the magnetic flux, this decreasing the overall strength of the magnetic field in the solenoid with a resultant decrease in the available torque output. In devices exemplified by U.S. Pat. No. 3,311,859, the core has a flange at one end which mates with a cylindrical stator and, due to the large diameter of the mating surfaces, the air gap between the core and the stator is increased considerably, this materially increasing the reluctance in the path of the magnetic flux.

The rotary electromagnetic actuators disclosed in U.S. Pat. Nos. 3,234,436 and 3,289,133 show unitary or single piece construction stators. However, even if such single piece stators could be made, this would be highly impractical and costly to manufacture because it would require forming the stator, which has a substantially E-shaped cross-section, from solid stock material. By virtue of the generally small overall dimensions of such miniature rotary actuators, as suggested above, this is a difficult, time consuming and expensive task. Additionally, such single piece rotors of the types disclosed in these patents would, of necessity, have to be made from a relatively hard material such as cold rolled steel, which would permit the removal of the interior of the stator by appropriate machining steps. However, cold rolled steel or similar materials do not have the high permeabilities of other types of magnetic irons which, however, are not suitable for use in the manufacture of stators of the type shown in these two patents.

The rotors disclosed in the above patents are generally provided with counterbores for receiving a portion of a stator core, and are provided with coaxial hub portions which extend beyond the region of the counterbores. However, the hub and counterbore relationship in such rotors result in generally very small cross-sections between the hub and the rotor poles, this increasing the magnetic reluctance and magnetic flux losses with attendant decreases in output torque.

SUMMARY OF THE INVENTION

Accordingly, it is an object of the present invention to provide a high torque rotary electromagnetic actuator which overcomes the above-described disadvantages of prior art comparable actuators.

It is another object of the present invention to provide a rotary actuator of the miniature type which has output torques substantially higher than those presently known.

It is still another object of the present invention to provide a miniature rotary actuator which is simple in construction and economical to manufacture.

It is yet another object of the present invention to provide a rotary actuator which utilizes a U-shaped stator formed from a substantially planar sheet of magnetic iron.

It is a further object of the present invention to provide a miniature actuator which includes a generally U-shaped stator of unitary construction, and has a core staked to the stator outer portion by means of a press-fit or the like to minimize air gaps and decrease the reluctance to the magnetic flux flowing through the stator.

It is still a further object of the present invention to provide a miniature rotary actuator which is provided with a rotor having a hub portion which is so configurated so as to compensate for the reduced axial thickness formed when a counterbore is formed in the rotor to receive a portion of the core of the stator.

It is yet a further object of the present invention to provide an improved miniature rotary actuator which has a generally U-shaped stator of unitary construction made from a planar magnetic sheet material, and which has cam pole surfaces which gradually and continuously decrease the space or gap between the rotor pole pieces and the associated stator pole pieces when such pole pieces move into alignment with each other.

It is an additional object of the present invention to provide a miniature rotary actuator having a single unit or integral construction U-shaped stator made from a flat magnetic sheet material, and which includes a spacer extending between the stator pole pieces so as to maintain the desired spacing between the resulting stator pole pieces.

It is yet an additional object of the present invention to provide a miniature rotary actuator which utilizes a generally U-shaped stator made of single or unitary construction to which may be securely connected a core, the core being initially formed independently of the formation of the U-shaped stator portion to enable the stator core to be provided with a particularly smooth outer surface which eliminates surface irregularities existing in some prior art constructions which may engage and interfere with the rotary action of the rotor.

In order to achieve the above objects, as well as others which may become apparent hereafter, the high torque rotary electromagnetic actuator in accordance with the present invention comprises a generally U-shaped stator having two substantially parallel leg portions joined by a generally transverse connecting portion. The stator defines an axis of symmetry and a pair of stator pole pieces remote from said connecting portion. The stator is formed from a substantially planar sheet of magnetic iron. An elongate core is joined at one end to said connecting portion and arranged along said axis. A rotor is mounted on the other or free end of said core for rotation about said axis between said stator pole pieces. Stop means is provided for limiting rotation of said rotor between a first angular position wherein said rotor is substantially aligned with said stator pole pieces and a second angular position angularly displaced from said first angular position. Biassing means normally urges said rotor to said second angular position. A coil is coaxially mounted on said core for establishing a magnetic field in the actuator upon energization of said coil to urge said rotor to move from said second to said first angular positions against the action of said biassing means.

In order to materially increase the torque output of the rotary actuator, in addition to forming the U-shaped stator from a planar sheet of magnetic iron, said rotor, which has a predetermined axial thickness, is made from a magnetic material and is provided with a coaxial counterbore for at least partially receiving the core. The rotor is further provided with an axial hub portion extending beyond said region of the counterbore, the hub portion being configurated to compensate for the reduced axial thickness of said rotor and provide a path of increased cross-sectional area for the magnetic flux associated with the axial components of the magnetic field. In this manner, said axial hub portion and said path increased cross-sectional area decrease the magnetic reluctance of said path and increase the strength of said magnetic field.

To reduce the manufacturing costs and improve the characteristics of the actuator, the stator is advantageously formed by stamping the same from a flat sheet of magnet iron, and forming the same into said U-shaped by bending, with suitable dies and forming tools.

The rotor pole pieces are advantageously provided with cam surfaces which gradually and continuously decrease the space or gap between the associated rotor and the stator pole pieces as the rotor moves into an aligned position with the stator pole pieces. The position of cam surfaces on the rotor pole pieces makes the torque output more uniform over the anticipated range of rotation of the rotor.

By utilizing a construction which permits the use of higher permeability materials, as well as incorporating other structural features more fully described in the "Description of the Preferred Embodiment," it has been found that miniature rotary actuators in accordance with the present invention are capable of delivering power outputs or torques approximately 4–7 times that of the prior art units of the type disclosed in the patents discussed in the Background of the Invention.

BRIEF DESCRIPTION OF THE DRAWINGS

Further advantages of the invention will become apparent from a reading of the following specification describing an illustrative embodiment of the invention. This specification is to be taken with the accompanying drawings in which:

FIG. 3 is a cross-sectional view of the rotary actuator shown in FIG. 2, taken along line 3—3;

FIG. 4 is an enlarged fragmented and cross-sectional view of the rotor shown in FIG. 1, taken along the axis of the rotor, and showing a counterbore for receiving a portion of the stator core, and the enlarged axial hub portion which increases the cross-sectional area between the hub portion and the rotor pole faces to compensate for the counterbore;

FIG. 5 is an end elevational view of the rotor shown in FIG. 4, as viewed along line 5—5;

FIG. 6 is a top plan view of a blank of a substantially planar magnetic iron sheet material which is used to form the U-shaped stator outer shell shown in FIGS. 2 and 3;

DESCRIPTION OF THE PREFERRED EMBODIMENT

Figure 1:
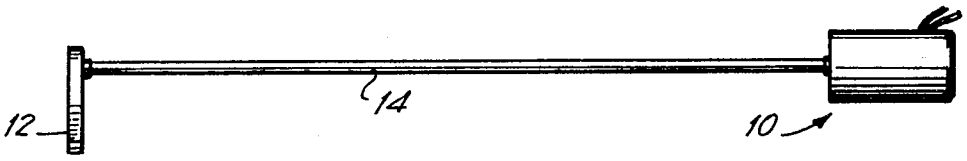
FIG. 1 is a side elevational view of a miniature rotary electromagnetic actuator indicator in accordance with the present invention, showing the actuator to be connected to a visual indicator by means of a generally long shaft.

Referring now specifically to the drawings, in which the identical or similar parts designated by the same reference numerals throughout, and first referring to FIG. 1, there is shown an actuator in accordance with the present invention generally designated by the reference numeral 10, and connected to an indicator 12 by means of a relatively long shaft 14. As will become evident from the description that follows, however, the actuator 10 of the present invention may be utilized with any type of miniature indicator and actuator, of the type generally used to display one of two indications such as "go"-"no-go," "off"-"on," and other like indications of the type commonly used on aircraft control panels. Also, while the indicator 12 is shown to be externally mounted of the actuator 10, the actuator of the present invention may be utilized with any of the conventional indicators, including internal flag indicators, external shaft indicators, rotating drum indicators and the like.

Figure 2:
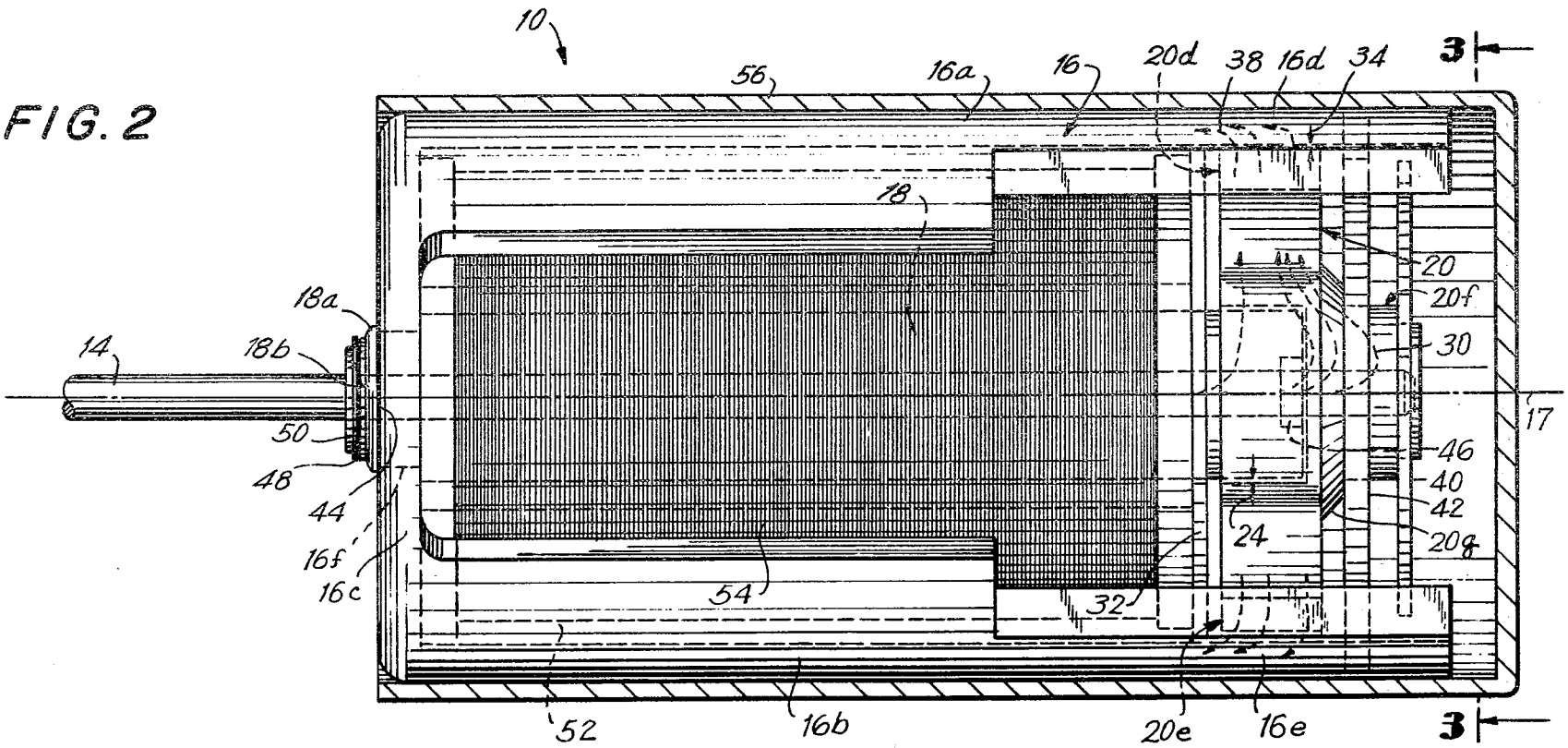
FIG. 2 is an enlarged view of the rotary actuator shown in FIG. 1, shown with a portion of the outer casing removed to show the details of construction of the actuator.

Referring to FIGS. 2 and 3, the actuator 10 is shown to include a generally U-shaped stator 16 having two substantially parallel leg portions 16*a* and 16*b* joined by a generally transverse connecting portion 16*c*. The stator 16 defines an axis of symmetry 17 and a pair of spaced and opposing stator pole pieces 16*d* and 16*e* which are remote from the connecting portion 16*c*. The stator is formed from a substantially flat sheet of magnetic iron, as will be more fully desccribed below.

An elongate core 18 is joined at one end to the connecting portion 16*c* and arranged along the axis 17. The core 18 is advantageously fabricated from one-eighth inch centerless round stock, to simplify machining and assembly, and increase the surface properties. An important feature of such a core is its extremely smooth exterior or outer surface, for reasons which will be more fully described hereafter. This is distinguished from the devices disclosed in U.S. Pat. Nos. 3,234,436 and 3,289,133 where the cores are formed out of the same solid stock from which the outer stator shell is formed, in which case the smoothness of the core must be achieved at great effort and expense.

The stator 16 and the core 18 are assembled by providing an axial hole 16*f* in the connecting portion 16*c*, and by providing an axial extending portion at one end of the core 18 which is dimensioned to be received within the axial hole 16*f* in press-fitting relation. To minimize the air gap and decrease in reluctance in the path of the magnetic flux, the axial extending portion of the core 18 has a diameter substantially less than the diameter of the core 18 so as to minimize the interfacing areas. As best shown in FIG. 2, the axial length of the axial extending portion is greater than the thickness of the connecting portion 16*c* so that the core 18 can be staked or riveted to the stator 16 by deforming that part of the axial extending portion which extends beyond or to the other side of the stator connecting portion to form, for example, a deformed annular flange or lip 18*a* and core end 18*b*.

A rotor 20 is mounted on the free end of the core 18 for rotation about the axis 17 between the stator pole pieces 16*c*, 16*e*.

Referring more specifically to FIGS. 4 and 5, the rotor 20 is made from any suitable magnetic material which can easily be machined, such as cold rolled steel, and has a main body portion 20*a*. The main body portion has an axial width 22, and the rotor is provided with an axial bore 20*b* which includes an axial counterbore 20*c* which has an axial depth or length which is comparable to the width 22 of the rotor. The axial thickness or width 22, and the counterbore 20*c* are of dimensions selected to at least partially receive one end of the core 18, as shown in FIG. 2.

The rotor 20 is generally elongate and has a pair of opposing or spaced pole pieces 20*d* and 20*e* disposed on opposite sides of the counterbore 20*c*. Although the rotor 20 is shown in FIGS. 3 and 5 to have a generally hour-shaped configuration, this is clearly not a critical feature of the present invention, and straight or rectangular rotors may, for example, also be used.

An important feature of the present invention is that the rotor 20 is provided with an axial hub portion 20*f* which extends beyond the other or free end of the core 18, the rotor hub portion 20*f* being configurated to compensate for the reduced axial thickness or width 22 of the rotor resulting from the provision of the counterbore 20*c* and to provide a path of increased cross-sectional area for the magnetic flux associated with the axial components 30 of the magnetic field. In this manner, the hub portion 20*f* and the path increased- cross-sectional area decreases the magnetic reluctance in the path and increases the strength of the magnetic field in the actuator. To achieve the increased cross-sectional area and decreased magnetic reluctance, and to prevent the magnetic flux from being choked off in the rotor with attending considerable magnetic losses, the present invention contemplates building up the rotor with magnetic material in the region of the cross-sectional dimensions decreased by the counterbore 20*c*. In the presently preferred embodiment shown, referring to FIG. 4, the axial hub portion includes a conical frustum portion 20*g* adjacent to the rotor main body portion 20*a*, and provided with a cylindrical portion 20*h*. The portions 20*g* and 20*h* represent enlarged axial hub portions which facilitate the flow of higher magnetic fluxes through the rotor, to thereby permit the rotor to focus concentrated magnetic fields between the rotor and the stator pole pieces. This, in turn, materially increases the available torque by the actuator.

Referring to FIG. 4, the axial hub portion 20*f* is shown with a cylindrical end portion 20*i*. In the typical prior art hub, the entire hub is of uniform diameter along the axial length thereof and smaller than the diameter of the cylindrical counterbore. The specific manner in which the axial hub portion 20*f* is configurated is not in and of itself critical, and it should be evident to those skilled in the art that any configuration or shape of the hub portion 20*f* which provides areas of increased cross-sectional area for the flow of magnetic flux can be used. In the presently preferred embodiment, the regions of increased cross-sectional area are represented by the arrows 26 and 28.

The diameter of the counterbore is selected to closely correspond to the diameter of the core 18, so as to leave a very small gap 24 therebetween, best shown in FIG. 2. As described above, the core is provided with a smooth outer surface, so that the surface irregularities inherent in prior art constructions are avoided which may otherwise engage and interfere with the free rotary movements or actions of the rotor 20.

The stator 16 is formed of a high permeability magnetic material, such as "Armco" magnetic iron. This type of magnetic iron is frequently used to make transformer or solenoid core laminations, and such materials are generally soft and flexible. Since the spacing between the stator pole 16*d* and 16*e* is critical, and it is desirable to maintain the leg portions 16*a* and 16*b* parallel to each other and to the axis 17 for optimum performance, there is provided in the presently preferred embodiment a spacer 32 which is in the nature of an annular disc made of a non-magnetic material. Such a disc is coaxially disposed on the core 18 and has an outer diameter equal to the desired spacing between the stator pole pieces 16*d*, 16*e*. The spacer 32 may, therefore, simply consist of a brass ring having the aforementioned outer diameter, and having an inner diameter substantially equal to the diameter of the core 18. The use of such a spacer assures that the pole pieces 16*d*, 16*e* maintain their spacing at the desired distance and that the critical air gap 34 between the rotor and stator pole faces are maintained in all positions or orientations of the actuator 10.

According to another feature of the present invention, the free ends of the rotor which form the rotor pole pieces 20*d*, 20*e* each have a cam surface 20*j* whose radial spacing or distance continuously and variously changes along the circumferential length thereof, as shown in FIG. 5. Thus, one end of the cam surface 20*j* is spaced at a distance $r_1$ from the axis, while the other end of that same cam surface 20*j* is spaced at a distance $r_2$ from the axis, the difference between the two radial distances being represented by the arrows 36. Such cam surfaces gradually and continuously decrease the space or gap 34 between the rotor and the stator pole pieces when the associated pole pieces are in substantially coextensive or opposing positions as shown, for example, in FIGS. 2 and 3, and the rotor 20 is moving in a direction to align itself with the stator pole pieces 16*d*, 16*e*. It is also possible to provide the above-described cam surface in only one of the rotor pole faces, although normally the cam surfaces would be provided on both ends of the rotor 20. The provision of the cam surfaces 20*j* improves the linearity of the torque output over the rotational range of interest.

Maintaining small gaps or spaces 24, 34, and by enlarging the cross-sectional dimensions of the hub portion 20*f* as above-described, decreases the reluctance of the magnetic circuit, the enlarged hub portion 20*f* serving to recapture some of the magnetic lines of force which would normally extend beyond the rotor and, therefore, bypass the rotor pole pieces in returning to the stator. By enlarging the hub portion 20*f* as suggested, such field lines 30 are reintroduced into the rotor main body portion 20*a* to increase the strength or concentration of the magnetic lines of force 38 which extends across the air gap 34, this increasing the output torque made available by the actuator.

Conventional stop means 40 is mounted on the rotor 20, and namely the axial portion 20*f* thereof, for limiting rotation of the rotor between a first angular position wherein the rotor 20 is substantially aligned with the stator pole pieces 16*d*, 16*e*, and a second angular position which is angularly displaced from said first angular position. Typical angles of rotation of such actuators is 60°, although the stop means may be designed to provide less angular movement of rotation than that amount. The stop 40 may be fixedly joined or connected to the rotor 20 in any conventional manner and has portions or arms 40*a* and 40*b* which radially extend beyond the radial distance of the rotor pole pieces 20*d*, 20*e* so that the arms 40*a*, 40*b* abut against the stator to provide well defined angular limiting positions of the rotor.

Biassing means in the nature of a helical spring 42 is provided for urging the rotor to the second angular position or non-aligned position of the rotor with the stator pole pieces. The spring 42 has the innermost end thereof, 42*b* mounted on the cylindrical hub portion 20*h*, and there is provided a cut-out 20*k* to receive the end of the spring 42*b* as suggested in FIG. 3. The outermost end of the spring 42*a* is likewise received within a groove a slot 16*g* formed in one of the pole pieces 16*d*, 16*e*. In this connection, it may be noted that one of the reasons for using a conical frustum portion 20*g* in the manner shown in FIG. 4, which is tapered in the manner indicated, is to minimize or reduce the frictional engagement of forces between the hub portion 20*g* and one or more of the helical turns of the spring 42.

To minimize the rotational resistance of the shaft 14, there are provided conventional jewels, such as sapphire jewels 44 and 46, the shaft being axially fixed and connected to the stator 16 by means of a spacer 48 and a retainer 50, which may be of any conventional type.

A coil 52, wound on a bobbin 54, is coaxially mounted on the core 18 for establishing a magnetic field in the actuator 10 upon energization of the coil by a suitable AC or DC voltage. Such magnetic field produces a magnetic flux which flows through the magnetic circuit including the stator 16, the core 18, and the rotor 20. The flux extending between the rotor and the stator pole pieces seek to align the rotor with the pole pieces in a conventional or known manner to thereby move the rotor from the second above defined position to the first defined angular position against the action of the helical spring 42.

Once assembled, the actuator 10 is covered by a casing or housing 56 which is generally cylindrical as shown in FIGS. 2 and 3 to close the end of the actuator in the region of the rotor 20 to protect the rotor and keep out dust and other contaminants from the actuator.

Referring to FIG. 6, there is shown a blank 58 of the type from which the stator 16 is made. The blank 58 can be stamped from high permeability magnetic iron such as "Armco" magnetic iron. The blank 58 is generally rectangular as shown, but provided with a circular portion 58*a* and a hole 58*b* which is initially used for centering the blank during the forming operation.

To form the stator 16, a die or nest is provided which has a generally cylindrical cavity therein, the dimensions of which correspond to the desired external dimensions of the U-shaped stator 16. A forming punch, generally cylindrical and having external dimensions corresponding to the desired internal dimensions of the U-shaped stator 16 is provided which has an axially extending centering nipple receivable within the hole 58*b* of the blank. The centering nipple is inserted into the hole 58*b* and the forming punch is forced into the die or nest cavity, thereby pulling the blank 58*b* therewith and shaping the blank into the generally U-shaped stator shown in the figures, which also has a generally cylindrical transverse cross-section. After the forming operation, which in some instances may deform the roundness of the hole 58*b*, the forming punch is removed from the die, the formed blank being retained therein for the purpose of maintaining the same centered during the step of reestablishing the hole in the center of the blank with the desired roundness and diameter for receiving the axially extending portion of the core 18 as described above. The staking or the rivetting of the core 18 to the stator 16 may also be performed at this time. By using inexpensive blanks 58 as shown, which can be readily and inexpensively formed into the desired stator configuration, the resulting stator is less costly to manufacture and provides enhanced magnetic properties due to the nature of the high permeability metals which can be used, and which could not be used with the prior art actuator stators.

The prior art actuator torque outputs, due to the above-described disadvantages, is very limited and provide no safety margin. The known designs enhance instead of reduce magnetic losses, and, therefore, deteriorate the available torque outputs. On the other hand, the present construction optimizes performance by minimizing the magnetic reluctances in the circuit, and, therefore, optimizing the available output torques. Of equal importance is that the stator is fabricated from flat stock magnetic iron, this eliminating extensive precision machining as well as increasing the electromagnetic flux intensities due, in part, to the singular or integral nature of the stator which minimizes air gaps and which, therefore, minimizes magnetic reluctance. Advantageously, the coil is manufactured with a three-piece bobbin enabling use of thinner flanges and core which increases the coil efficiency by allowing more volume for the winding. This permits the formation of increased intensity fields, again resulting in higher output torques.

Figure 8:
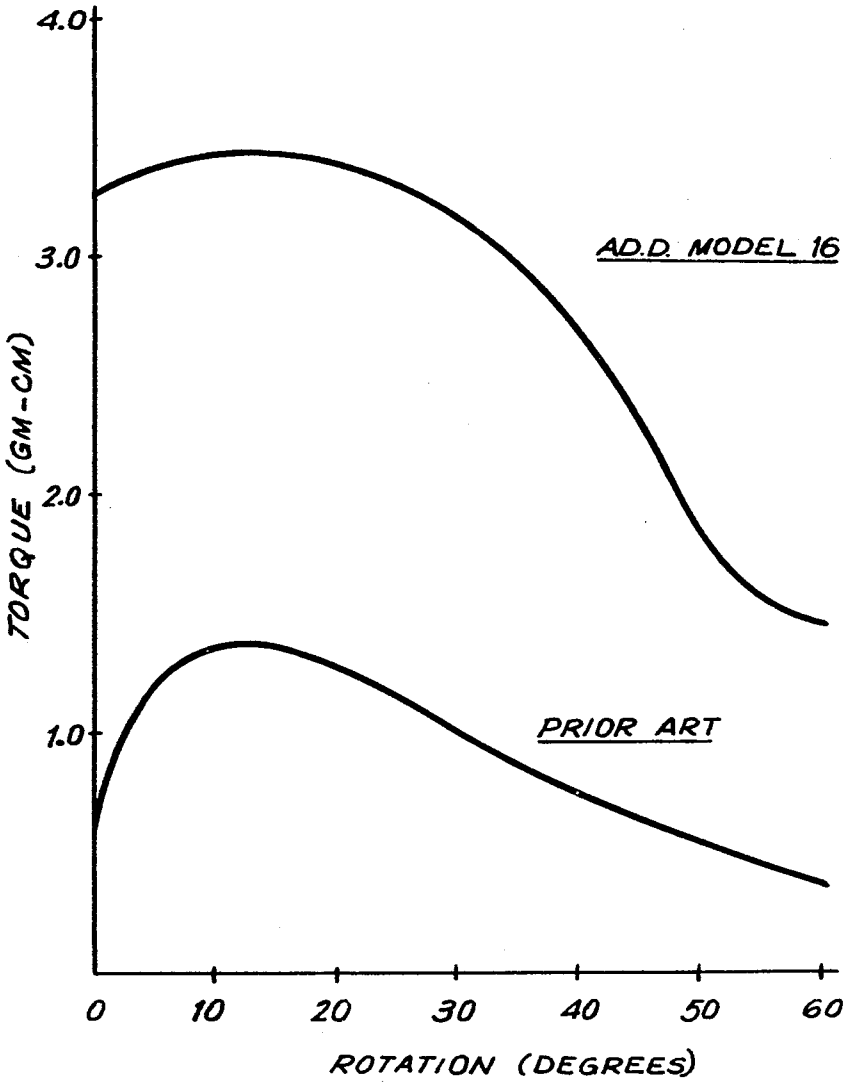
FIG. 8 is similar to FIG. 7, except that both the prior art as well as the actuator of the present invention are of a larger size and produce higher output torques.
Figure 7:
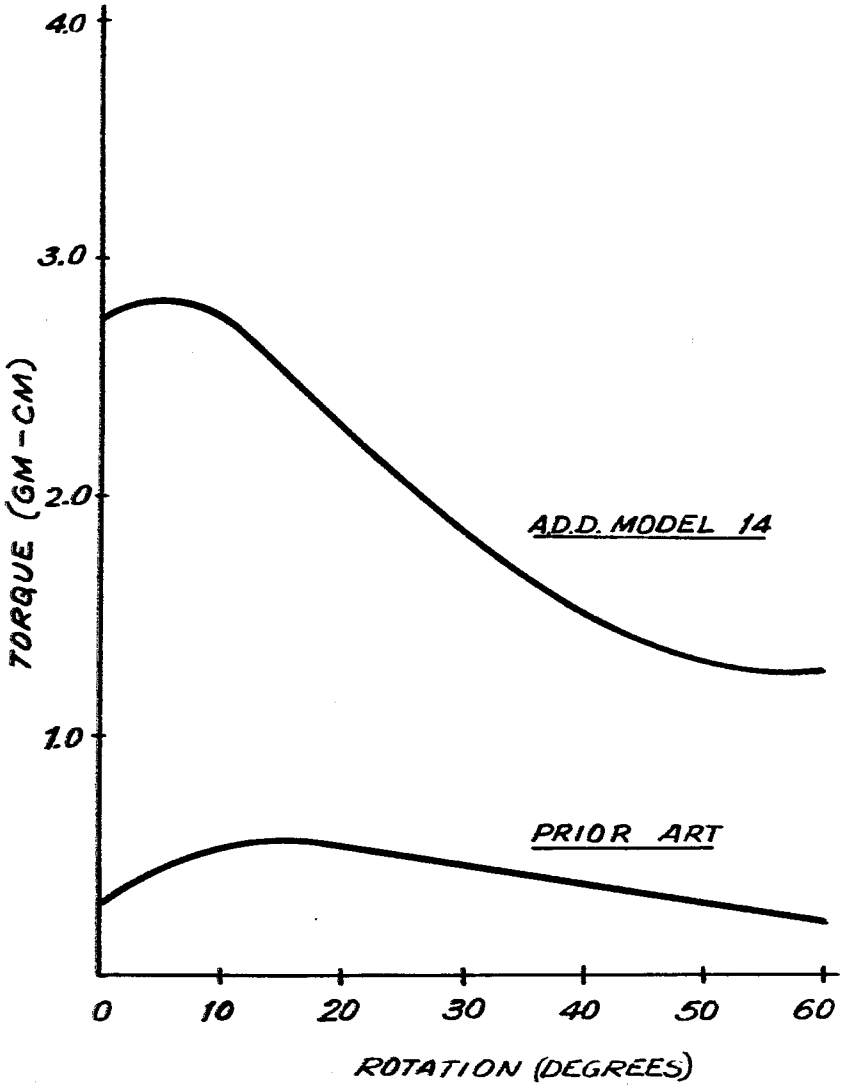
FIG. 7 shows comparative test results of a prior art miniature rotary actuator, and a rotary actuator of the same size manufactured in accordance with the present invention.

The rotary actuator devices described in U.S. Pat. Nos. 3,221,191; 3,311,859; 3,234,436; and 3,289,122 are all all assigned to Daco Instrument Company of Milford, Connecticut. The product catalog of Daco which describes its series D-LE Miniature Fail Safe Indicators and Actuators, provides torque versus rotation curves for two sizes of miniature rotary solenoids, denominated by that company as Size 5 and Size 6 Series D-LE Actuators. Referring to FIGS. 7 and 8, there are provided comparative curves or test data which compare the available torque outputs between the two above mentioned Daco devices, and comparably sized rotary actuators made in accordance with the present invention.

Referring to FIG. 7, the torque of the prior art (Size 5 D-LE Daco Miniature Rotary Solenoid) peaks at an angle of approximately 10°, where the torque is approximately 500mg-cm. On the other hand, applicant's A.D.D. Model 14 which is of the same size as the prior art unit, provides substantially higher initial torque, and provides higher torque throughout the rotation range. The same is true, referring to FIG. 8, to comparable rotary actuators which are of a larger size. In FIG. 8, the Daco Size 6 miniature rotary solenoid is compared with applicant's A.D.D. Model 16. Here, again, the initial torque is substantially higher and remains higher over the entire rotational range of interest. These comparative test curves were prepared by an independent testing facility which performed the tests on the above units. Based upon these curves, it becomes evident that the power output of rotary actuator units made in accordance with the present invention is approximately 4–7 times that of comparably sized units made in accordance with the prior art constructions. Such substantially higher torque outputs provide considerable safety margins and assure reliable operation of the units over a wide or extended applied voltage ranges.

It will be evident to those skilled in the art that the stop 40 and the spring 42 can be arranged so that the spring normally urges the rotor to the aligned position, and application of a voltage to the coil causes the rotor to turn or move to a second position angularly displaced from the aligned position. It is to be understood that the foregoing description of the presently preferred embodiment is exemplary only and many various modifications to the embodiment shown herein may be made without departing from the spirit and scope of the invention.

What is claimed is:

1. A high torque rotary electromagnetic actuator comprising a generally U-shaped stator having two substantially parallel leg portions joined by a generally transverse connecting portion and defining an axis of symmetry and a pair of spaced stator pole pieces remote from said connecting portion, said stator being formed from a substantially planar sheet of magnetic iron; an elongate core joined at one end to said connecting portion and arranged along said axis; a rotor mounted on the other or free end of said core for rotation about said axis between said pole stator pieces; stop means for limiting rotation of said rotor between a first angular position wherein said rotor is substantially aligned with said stator pole pieces and a second angular position angularly displaced from said first angular position; biassing means for urging said rotor to said second angular position; and a coil coaxially mounted on said core for establishing a magnetic field in the actuator upon energization of said coil to urge said rotor to move from said second to said first angular positions against the action of said biassing means, said rotor being made from a magnetic material and having a predetermined axial thickness and provided with a coaxial counterbore for at least partially receiving said core, and further being provided with an axial hub portion extending beyond said other or free end of said core, said rotor hub portion being configurated to compensate for the reduced axial thickness of said rotor and provide a path of increased cross-sectional area for the magnetic flux associated with the axial components of the said magnetic field, whereby said axial hub portion and said path increased cross-sectional area decrease the magnetic reluctance in said path and increase the strength of said magnetic field.

2. A rotary actuator as defined in claim 1, wherein said axial hub portion includes a conical frustum portion adjacent to the rotor main body portion.

3. A rotary actuator as defined in claim 1, wherein said axial hub portion includes a cylindrical portion.

4. A rotary actuator as defined in claim 3, wherein said axial hub portion further includes a conical frustum portion between the rotor main body portion and said cylindrical portion, said biassing means comprising a spiral spring acting between a stator pole piece and said cylindrical portion, said conical frustum portion being tapered to reduce frictional engagement with said spiral spring.

5. A rotary actuator as defined in claim 1, wherein said actuator is formed by stamping the same from a flat sheet of magnet iron, and forming the same into said U-shape by bending.

6. A rotary actuator as defined in claim 1, wherein said stator is made from a high permeability magnet iron.

7. A rotary actuator as defined in claim 1, wherein said rotor has two free ends respectively forming rotor pole pieces, at least one of said pole pieces having a cam surface which gradually and continuously decreases the space or gap between said at least one rotor pole piece and associated stator pole piece when said associated stator pole pieces are in substantially coextensive or opposing positions and said rotor is moving in a direction from said second towards said first angular positions.

8. A rotary actuator as defined in claim 7, wherein both of said rotor pole pieces are provided with cam surfaces.

9. A rotary actuator as defined in claim 1, further comprising spacer means for maintaining said leg portions oriented in the parallel direction to said axis.

10. A rotary actuator as defined in claim 9, wherein said spacer means comprises an annular disc made of a non-magnetic material coaxially disposed on said core and having an outer diameter equal to the desired spacing between said leg portions.

11. A rotary actuator as defined in claim 11, wherein said disc comprises a brass ring having an inner diameter substantially equal to the diameter of said core.

12. A rotary actuator as defined in claim 1, wherein said connecting portion of said stator is provided with an axial hole, and said core is provided with an axial extending portion dimensioned to be received within said axial hole in press-fitting relation.

13. A rotary actuator as defined in claim 12, wherein said axial extending portion has a diameter substantially less than the diameter of said core.

14. A rotary actuator as defined in claim 12, wherein the axial length of said axial extending portion is greater than the thickness of said connecting portion of said stator, said core being staked or riveted to said stator by deforming that part of said axial extending portion which extends beyond or to the other side of said stator connecting portion.

15. A high torque rotary electromagnetic actuator comprising a generally U-shaped stator having two substantially parallel leg portions joined by a generally transverse connecting portion and defining an axis of symmetry and a pair of spaced pole pieces remote from said connecting portion; an elongate core joined at one end to said connecting portion and arranged along said axis; a rotor mounted on the other or free end of said core for rotation about said axis between said stator pole pieces; stop means for limiting rotation of said rotor between a first angular position wherein said rotor is substantially aligned with said pole pieces and a second angular position angularly displaced from said first angular position; biassing means for urging said rotor to said second angular position; and a coil coaxially mounted on said core for establishing a magnetic field along said axis and in the actuator upon energization of said coil to urge said rotor to move from said second to said first angular positions against the action of said biassing means, said rotor being made from a magnetic material and having a predetermined axial thickness and provided with a coaxial counterbore for at least partially receiving said core, and further being provided with an axial hub portion extending beyond said other or free end of said core, said rotor hub portion being configurated to compensate for the reduced axial thickness of said core and provide a path of increased cross-sectional area for the magnetic flux associated with the axial components of said magnetic field, whereby said axial hub portion and said path increased cross-sectional area decrease the magnetic reluctance in said path and increase the strength of said magnetic field.

16. A rotary actuator as defined in claim 15, wherein said stator is formed from a substantially planar sheet of magnetic iron.

17. A high torque rotary electromagnetic actuator comprising a generally U-shaped stator having two substantially parallel leg portions joined by a generally transverse connecting portion and defining an axis of symmetry and a pair of spaced stator pole pieces remote from said connecting portion, said stator being formed from a substantially planar sheet of magnetic iron; an elongate core joined at one end to said connecting portion and arranged along said axis; a rotor mounted on the other or free end of said core for rotation about said axis between said pole stator pieces; stop means for limiting rotation of said rotor between a first angular position wherein said rotor is substantially aligned with said stator pole pieces and a second angular position angularly displaced from said first angular position; biassing means for urging said rotor to said second angular position; and a coil coaxially mounted on said core for establishing a magnetic field in the actuator upon energization of said coil to urge said rotor to move from said second to said first angular positions against the action of said biassing means, said rotor being provided with a coaxial counterbore for at least partially receiving said core with a small clearance, and said core being provided with a smooth outer surface, whereby surface irregularities which may engage and interfere with the rotary action of said rotor core are eliminated.

* * * * *